US005852971A

United States Patent [19]

Yuyama et al.

[11] Patent Number: 5,852,971

[45] Date of Patent: Dec. 29, 1998

[54] PRINTING APPARATUS FOR MEDICINE BAG

[75] Inventors: Shoji Yuyama; Reiji Kitagawa, both of Toyonaka; Satoshi Fukagawa, Nishinomiya, all of Japan

[73] Assignee: Yuyama Mfg. Co., Ltd., Toyonaka, Japan

[21] Appl. No.: 724,511

[22] Filed: Sep. 30, 1996

[30] Foreign Application Priority Data

Sep. 28, 1995 [JP] Japan ..... 7-250850

[51] Int. Cl.[6] ..... B41F 17/00

[52] U.S. Cl. ..... 101/35; 101/211

[58] Field of Search ..... 101/35, 232, 211, 101/483; 271/180, 197, 9.06

[56] References Cited

U.S. PATENT DOCUMENTS 4,275,977 6/1981 Joice ..... 271/197

FOREIGN PATENT DOCUMENTS 360040355A 2/1985 Japan ..... 271/9.06

61-158480 7/1986 Japan .

3-221482 9/1991 Japan .

4-112055 4/1992 Japan .

4-115112 10/1992 Japan .

6-17523 5/1994 Japan .

7-9644 3/1995 Japan .

*Primary Examiner*—Eugene H. Eickholt

*Attorney, Agent, or Firm*—Wenderoth, Lind & Ponack

[57] ABSTRACT

A printing apparatus for printing medicine bags includes a plurality of cassettes in which different type of medicine bags are contained, the cassettes being vertically spaced, printers for printing predetermined information on the medicine bags, a medicine bag conveying member, and a control unit. The medicine bag conveying member is pivotable at an outlet thereof so that an inlet thereof communicates with any one of the cassettes to convey medicine bags to the printers from the cassettes. The control unit selects any one of the cassettes, causes the medicine bag conveying member to pivot so that the inlet of the medicine bag conveying member is connected to the selected cassette, causes the medicine bag conveying member to convey the medicine bag to a selected printer, and causes the printer to print the predetermined information on the medicine bag.

10 Claims, 5 Drawing Sheets

PRINTING APPARATUS FOR MEDICINE BAG

BACKGROUND OF THE INVENTION

1. Field of the Invention

The present invention relates to an apparatus for printing on information such as name of patient, how to use, note, date, name of hospital and the like onto a medicine bag containing, e.g. medicine dispensed in a dispensary of a hospital.

2. Description of the Prior Art

Recently, information, for example, name of patient, how to use and the like is printed on medicine bag by means of a printing apparatus in a hospital. Various arrangements for such printing apparatus as described hereinafter have been proposed in order to efficiently perform printing on medicine bags.

Japanese Laid-open patent publication No. 61158480 discloses a printing apparatus in which a plurality of medicine bag holders containing respective different sizes of medicine bags are mounted on an apparatus body.

Japanese Laid-open patent publications No. 3221482 and 4112055 disclose printing apparatuses in which a plurality of printers are provided instead of medicine bag holders described above.

In these apparatuses, the medicine bag holder or the printer containing a required size of medicine bags is selected in accordance with input prescription data to print information on the desired medicine bag.

Japanese patent publication No. 6-17523 discloses a printing apparatus which is provided with a plurality of printers and a course switching device so that a medicine bag is supplied from one place to any one of the printers through a course switched by the course switching device. In this apparatus, even though the apparatus is provided with one cassette containing medicine bags, a medicine bag can be supplied to one printer by the course switching device while the other printers are in printing operation.

However, the above described apparatuses have the following disadvantages.

In the apparatus of the publication No. 61-158480, since the conveying distance and path from each medicine bag holder to the printer is different, it is necessary to set a plurality of print starting points. Thus, the print starting points are apt to deviate from original points thereof in front and rear directions, and it is difficult to adjust such starting points. As a result, the apparatus is expensive.

In the apparatus of publications No. 3-221482 and 4112055, many printers are necessary according to the sizes of the medicine bags, resulting in an expensive apparatus as a whole. Moreover, as many printers are arranged in the apparatus, a wide space occupied by the printers is necessary.

In the apparatus of publication No. 6-17523, as the medicine bag is supplied from one place, the apparatus is not able to coup with printing of different sizes of medicine bags.

SUMMARY OF THE INVENTION

An object of the present invention is, therefore, to provide a printing apparatus for printing medicine bags and which has a simple construction and is able to effectively print information onto different sizes of medicine bags.

In order to achieve the aforementioned object, according to the present invention, there is provided a printing apparatus for printing medicine bags and comprising:

a plurality of medicine bag containing means in which different types of medicine bags are to be contained, the medicine bag containing means being vertically spaced;

a medicine bag printing means for printing predetermined information on a medicine bag;

a medicine bag conveying means which is pivotable at an outlet thereof so that an inlet thereof communicates with any one of the medicine bag containing means to convey a medicine bag to the medicine bag printing means from the medicine bag containing means; and a control means for selecting any one of the medicine bag containing means, for causing the medicine bag conveying means to pivot so that the inlet of the medicine bag conveying means is connected to the selected medicine bag containing means, for causing the medicine bag conveying means to convey the medicine bag to the medicine bag printing means, and to cause the medicine bag printing means to print the predetermined information on the medicine bag.

The printing apparatus may further comprise a plurality of medicine bag introducing portions, each of which introduce a medicine bag to the inlet of the medicine bag conveying means from the respective medicine bag containing means.

The printing apparatus according to the present invention has advantages that the medicine bag conveying means has a single and simple construction, and in spite of such construction printing on different sizes of medicine bags is possible without increasing the number of the printing means.

In a preferred embodiment, a plural pairs of the medicine bag conveying means and the medicine bag printing means may be provided, and the medicine bag introducing portions may include at least one switching member which is pivotable at an inlet thereof so that an outlet thereof communicates with the inlet of any one of the medicine bag conveying means to convey a medicine bag to any one of the medicine bag conveying means and the medicine bag printing means from one of the medicine bag containing means.

Moreover, in the case that operation of one printing means is not halted, the control means may cause the switching member pivot to convey a medicine bag to another medicine bag printing means the operation of which is halted.

According to the embodiment as described above, it is possible to prevent the medicine bag printing means from being idle in spite of the situation that the next medicine bag waits to be printed. This enables enhancement of the efficiency of the printing operation. In particular, if the switching member is provided so as to communicate with the medicine bag conveying portion corresponding to the medicine bag containing means containing medicine bags to be frequently used, the efficiency of the printing operation is greatly enhanced.

In another preferred embodiment, each medicine bag containing means includes feed rollers which come into pressure contact with the upper surface of an upper medicine bag contained therein, a feed motor which drives the feed rollers to feed the medicines bag one by one, and a one-way clutch which is interposed between the feed rollers and the feed motor.

Alternatively, one-way clutches may be provided in place of the feed rollers so that the medicine bag is directly fed out by the one-way clutches.

According to the embodiment as described above, when the feed motor is driven, the rotation torque of the feed motor is transmitted to the feed rollers through the one-way clutch, which causes the medicine bags to be discharged one by one. When the medicine bag conveying means takes hold of the front end of a medicine bag during discharge thereof, a tension load is applied to the medicine bag. The tension load provides the feed rollers with an over-load higher than the rotation torque of the feed rollers, which causes the feed rollers to over-run relative to the feed motor, thus preventing the medicine bag from being torn.

BRIEF DESCRIPTION OF THE DRAWINGS

Further objects and advantages of the present invention will become clear from the following description taken in conjunction with preferred embodiments thereof and with reference to the accompanying drawings, in which.

DETAILED DESCRIPTION OF THE PREFERRED EMBODIMENT

Figure 1:
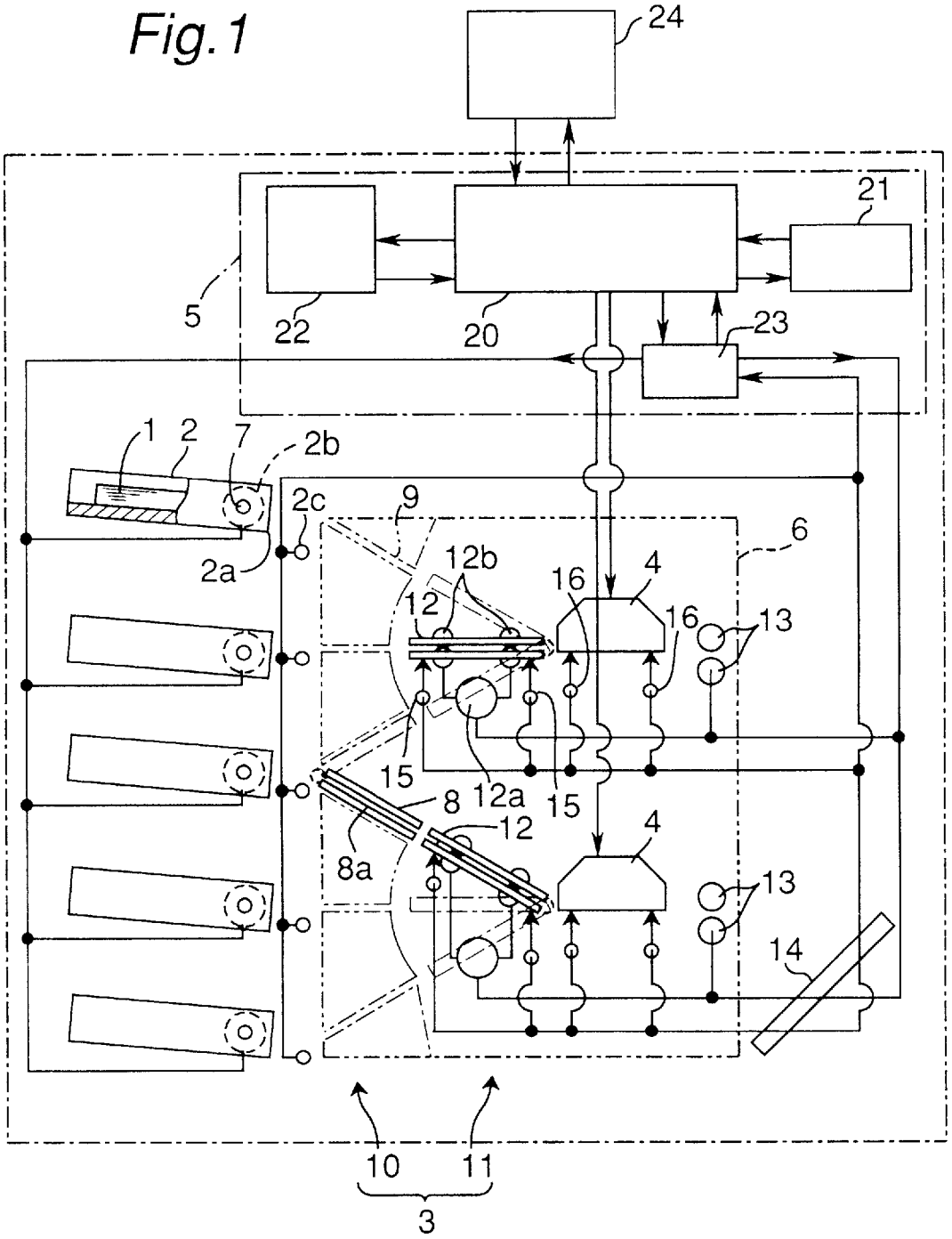
FIG. 1 is a schematic diagram of a printing apparatus for printing medicine bags according to the present invention.
Figure 2:
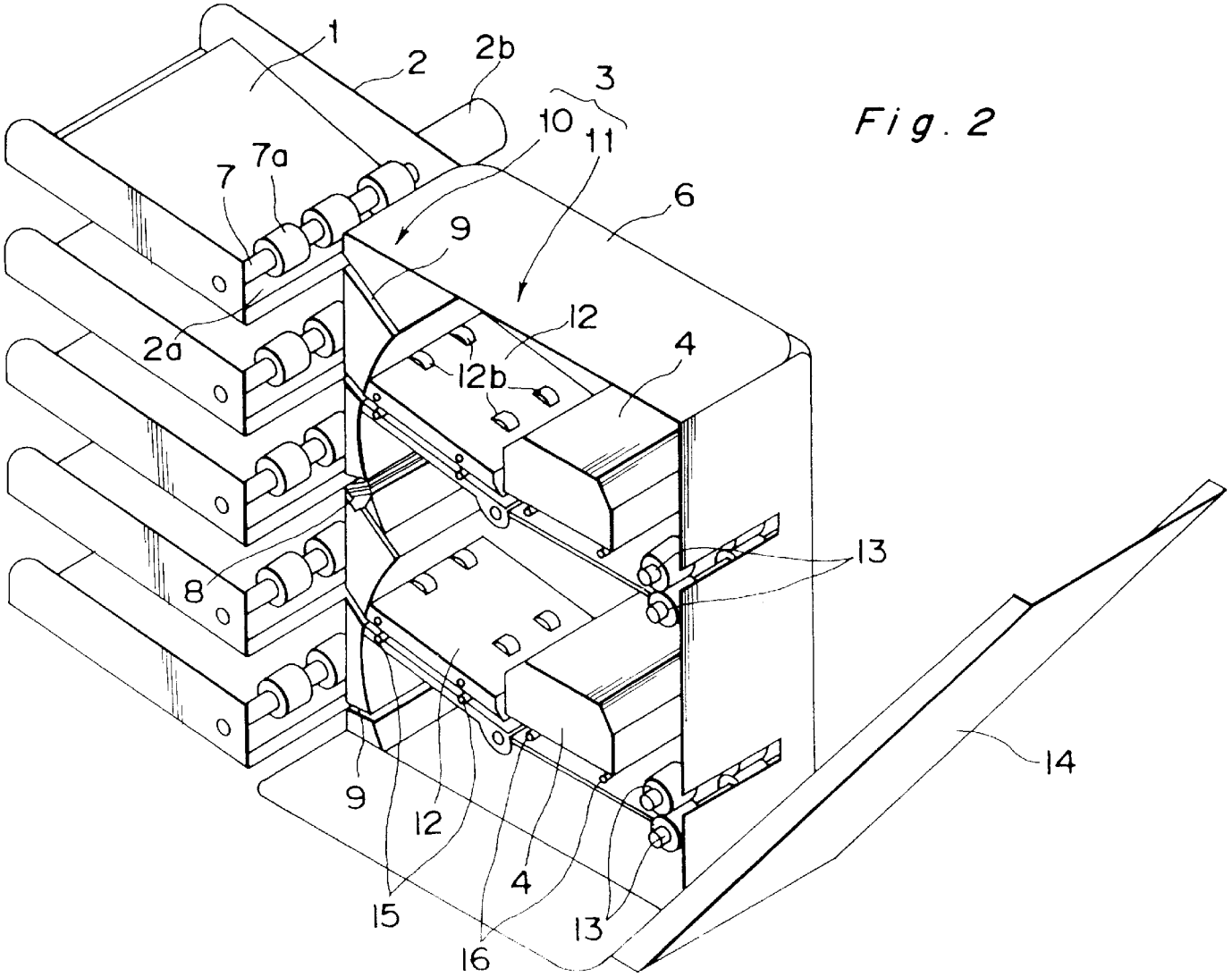
FIG. 2 is a perspective view of the printing apparatus of FIG. 1.

A printing apparatus according to the present invention, as shown in FIG. 1 and 2, comprises a plurality of containers such as cassettes 2 containing a plurality of medicine bags 1, conveying means 3 for conveying the medicine bags 1 from the cassettes 2, printers 4 which print information onto the medicine bags conveyed from the cassettes 2 by the conveying means 3, a control unit 5 which controls a series of operations for conveying and printing of the medicine bags 1. The conveying means 3 and the printers 4 are accommodated in a common case 6.

The cassettes 2 are vertically disposed and inclined so that each medicine bag outlet 2*a* formed at a front edge of the cassette 2 is lower than a rear edge opposite to the front edge of the cassette 2. A plurality of medicine bags 1 can be contained in a stack in each cassette. In the vicinity of the medicine bag outlet 2*a* of each cassette 2 is provided a shaft 7 which is rotatable by the drive of a feed motor 2*b*. Three feed rollers 7*a* are disposed on shaft 7 so as to come into pressure contact with the upper surface of a medicine bag 1, whereby the medicine bags 1 in the cassette 2 can be discharged one after another through the medicine bag outlet 2*a*.

A different size of medicine bags 1 are contained in each cassette 2. A large size of medicine bags 1 are contained in the uppermost two cassettes 2; a normal size of medicine bags 1 frequently used are contained in the middle cassette 2; and a small size of medicine bags 1 are contained in the lowermost two cassettes 2.

In the vicinity of the medicine bag outlet 2*a* of each cassette 2 is provided a sensor 2*c* for sensing the medicine bag discharged from the cassette 2. A sensing signal of the sensor 2*c* is sent to control unit 5, whereby the control unit 5 detects whether or not medicine bags 1 are contained in the cassette 2.

The conveying means 3 is comprised of a medicine bag introducing portion 10 comprising a switching member 8 and four introducing or discharge paths 9, and a medicine bag conveying portion 11 which conveys a medicine bag 1 introduced from the switching member 8 or any one of the introducing paths 9 into either printer 4.

The switching member 8 includes a medicine bag introducing path 8*a*. The inlet of the switching member 8 is opposed to the medicine bag outlet 2*a* of the middle cassette 2. The switching member 8 is pivotable around an axis provided in the vicinity of the inlet thereof between an upper conveying position and a lower conveying position by means of the operation of a not shown motor so as to switch the introducing path 8*a* to deliver the medicine bag 1 to be frequently used from the middle cassette 2 to either printer 4 through the medicine bag conveying portion 11.

The introducing paths 9 are formed in the case 6. The inlet of each introducing path 9 is opposed to the medicine bag outlet 2*a* of a corresponding respective cassette 2. Outlets of the upper two introducing paths 9 and the switching member 8 positioned in the upper conveying position are disposed on the same arc or circular line. Similarly, the outlets of the lower two introducing paths 9 and the switching member 8 positioned in the lower conveying position are disposed on the same arc or circular line.

The medicine bag conveying portion 11 comprises a pair of conveying members 12. The outlet of the upper conveying member 12 is opposed to the inlet of the upper printer 4, while the outlet of the lower conveying member 12 is opposed to the inlet of the lower printer 4. Each conveying member 12 is pivotable around an axis provided in the vicinity of the outlet thereof by means of the operation of a not shown motor. The upper conveying member 12 is pivotable so that the inlet of the upper conveying member 12 can communicate with the outlet of either one of the upper two introducing paths 9 or the outlet of switching member 8 positioned at the upper conveying position. The lower conveying member 12 is pivotable so that the inlet of the lower conveying member 12 can communicate with the outlet of either one of the lower two introducing paths 9 or the outlet of switching member 8 positioned at the lower conveying position. The conveying members 12 are provided with a plurality of conveyance rollers 12*b* rotated by the operation of respective motors 12*a* so as to convey medicine bags 1.

The positions of the switching member 8 and the conveying members 12 are detected by respective sensors.

The printers 4 are provided in correspondence with the conveying members 12 so as to print a predetermined information on a medicine bag 1 conveyed from a conveying member 12 in accordance with an input print data. The print data include a data of a medicine bag to be selected as well as a prescription data, patient name, how to use and so on. The color printed by the printers 4 may be changed in accordance with differences of printing matter (for example, the difference between a medicine for external application and an internal medicine). At the outlet of the printers 4 are provided respective pairs of discharge rollers 13 so that printed medicine bags 1 can be discharged to a discharge tray 14.

At the inlets and outlets of the conveying members 12 and the printers 4 are provided respective sensors 15, 16 for sensing whether or not the medicine bags 1 are steadily fed to or perfectly discharged from the conveying members 12 and printers 4.

The control unit 5 is comprised of a central processing unit (CPU) 20, a memory 21, a display 22 and a driver circuit 23. The CPU 20 transmits data to and receives data from an external terminal unit 24 and controls the printing apparatus in accordance with input signals from the sensors to print predetermined information onto the medicine bags 1.

Figure 3A:
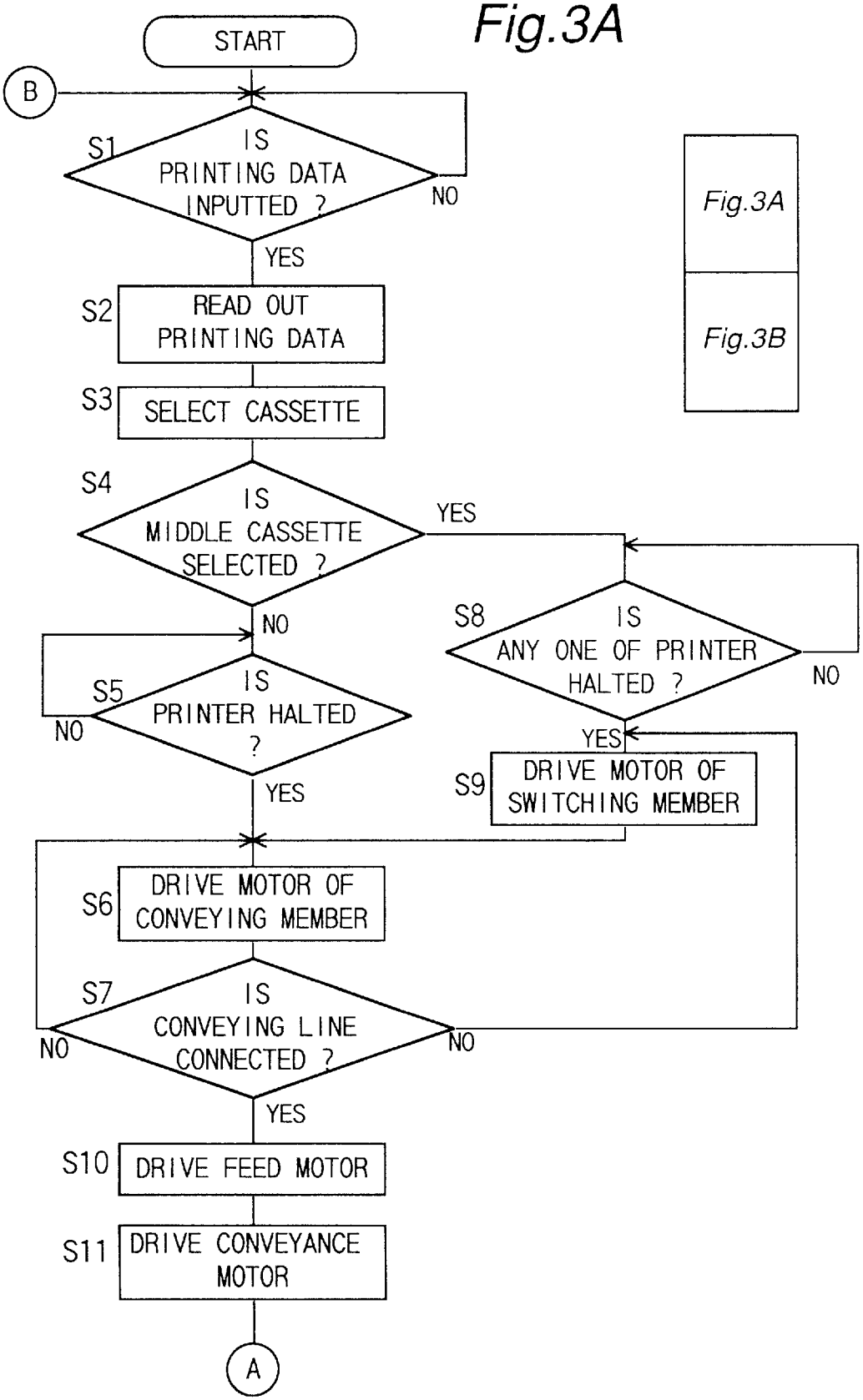
FIG. 3A and 3B are flow charts showing control of printing by the printing apparatus of FIG. 1.
Figure 3B:
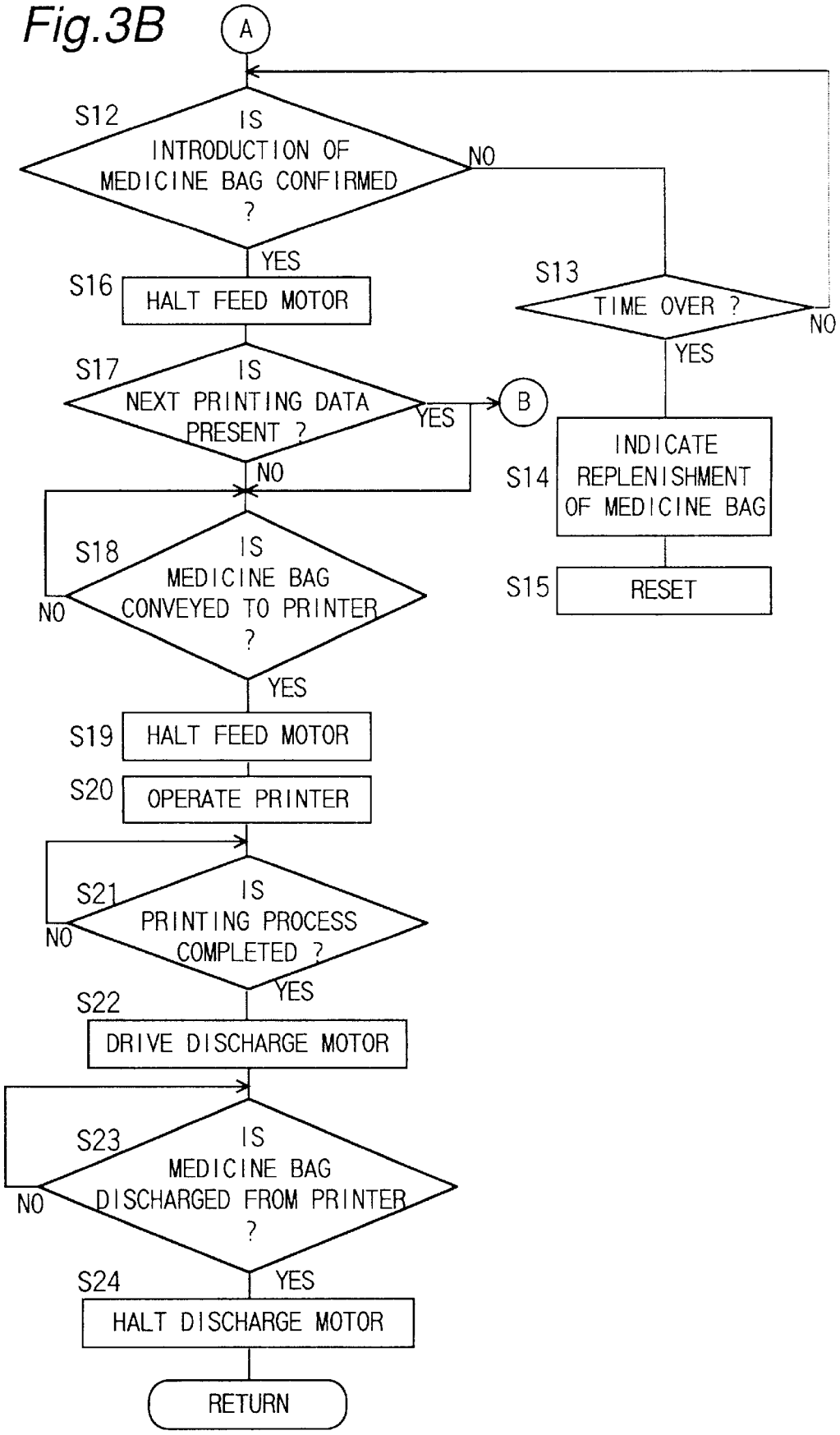

The operation of the printing apparatus for medicine bags is described hereinafter with reference to the flowchart of FIG. 3A and FIG. 3B.

If printing data is input from the external terminal unit 24 (Step S1), the printing data is read out (Step S2) to select the corresponding cassette 2 (Step S3). In the case that a plurality of printing data are input, the data is once stored in the memory 21, so that while a conveying and printing process in accordance with earlier printing data as described below are executed, the process in accordance with successive printing data cannot be executed until a judgment is performed of whether or not the successive printing data waits to be processed (refer to Step S17).

Then, whether the middle cassette 2 is selected or not is judged (Step S4). If an upper or lower cassette 2 other than the middle cassette 2 is selected, then judgement is made whether or not the printing operation of the respective printer 4, i.e. the printer 4 to which the medicine bag 1 is conveyed from the cassette 2 selected based on the printing data, is halted (Step S5). In detail, in the case that the upper cassette 2 containing the large size of the medicine bag 1 is selected, judgement is made of whether or not the printing operation of the upper printer 4 is halted; while in the case that the lower cassette 2 containing the small size of the medicine bag 1 is selected, judgement is made of whether or not the printing operation of the lower printer 4 is halted. If the printing operation of the related printer 4 is not halted, the execution of the conveying process of the medicine bag 1 is caused to wait; if the printing operation of the related printer 4 is halted, the motor of the respective conveying member 12 is driven to pivot the conveying member 12 until a conveying path of the medicine bag from the selected cassette 2 to the halted printer 4 is connected (Step S6, S7). In detail, in the case that a cassette 2 containing the large size of the medicine bag 1 is selected, the upper conveying member 12 is pivoted to position the inlet of the conveying member 12 at the outlet of the introducing path 9 communicating with the selected upper cassette 2. Moreover, in the case that a cassette 2 containing the small size of the medicine bag 1 is selected, the lower conveying member 12 is pivoted to position the inlet of the conveying member 12 at the outlet of the introducing path 9 communicating with the selected lower cassette 2.

If the middle cassette 2 containing the normal size of the medicine bag 1 is selected, judgement is made of whether or not the printing operation of any one of the printers 4 is halted (Step S8). If both the upper printer 4 and the lower printer 4 are under operation, the execution of the conveying process of the medicine bag 1 is caused to wait. If any one of the upper printer 4 and the lower printer 4 is halted, the motor of the switching member 8 is driven (Step S9), and the motor of the conveying member .12 is driven, as described above, to pivot the switching member 8 and the conveying member 12 until a conveying path of the medicine bag from the selected cassette 2 to the halted is printer 4 is connected (Steps S6, S7).

When the conveying path is thus connected, the feed motor 2*b* and the conveyance motor 12*a* are driven (Steps S10, S11). Then, the introduction of the medicine bag 1 is confirmed by judging whether or not the medicine bag 1 has been perfectly discharged from the cassette 2 in accordance with the signal from the sensor 2*c* (Step S12). If the introduction of the medicine bag 1 is not confirmed, further progress of the operation is delayed (Step S13). In this situation, when a predetermined delay time has elapsed, replenishment of a medicine bag is indicated, thereby to inform the user of such situation (Step S14), and then the printing apparatus is reset (Step S15). The medicine bag 1 concerned is placed on the respective cassette 2, and the process is commenced in the same manner as described above. If the introduction of the medicine bag 1 is confirmed, the feed motor 2*b* is halted (Step S16), and judgement is made whether or not the next printing data waiting to be processed is present (Step S17).

In the case that the next printing data waiting to be processed is not present, further progress of the process is delayed until the sensor 16 detects the fact that the medicine bag 1 is conveyed to the printer 4 (Step S18) If the sensor 16 detects the fact that the medicine bag 1 is conveyed to the printer 4, the conveyance motor 12*a* is halted (Step S19), and then the printer 4 is operated (Step S20). In the case that the next printing data waiting to be processed is present, the printing process by the printer 4 is executed in the same manner described above (Steps S18–S19). Simultaneously, returning to the Step S1, the preceding process as described above is commenced in accordance with the next printing data in parallel to the printing process of the previous printing data. In the parallel process as described above, even though one medicine bag 1 is undergoing a printing process, the other next medicine bag 1 can be conveyed to commence the printing process thereof. This results in efficient printing. In the case that the next printing data requires use of the printer 4 which is being used in the previous printing operation, another printing data which can use the remaining printer 4 may be processed prior to processing the next printing data. This enables enhancement of printing efficiency.

When the printing process of a medicine bag is executed as described above and is completed (Step S21), the discharge motor of the discharge roller 13 is driven (Step S22). Then, if the fact that the medicine bag 1 is completely discharged from the printer 4 is confirmed by the sensor 16 (Step S23), the discharge motor is halted to finish the sequential printing process (Step S24).

Although, in the aforementioned embodiment, the judgment of whether or not the next printing data waiting to be processed is present (Step 17) is executed before commencing the printing process, it is clear that the judgment may be executed during a printing operation, i.e. between Step S20 and Step S21, so as to highly enhance the efficiency of the operation.

Figure 4:
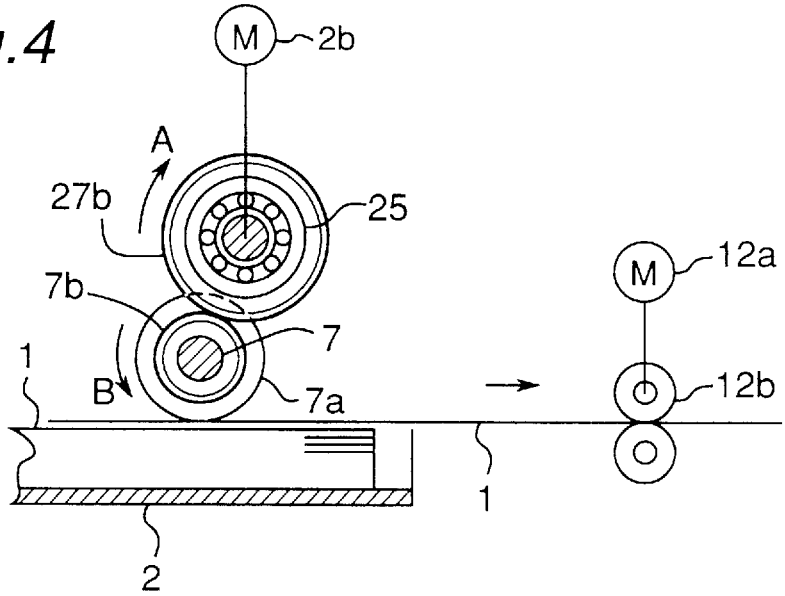
FIG. 4 is a schematic view of a portion of another embodiment of the present invention which is provided with a one-way clutch.
Figure 5A:
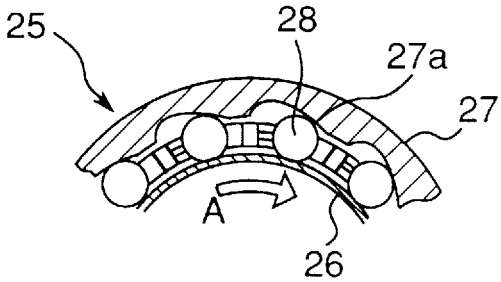
FIG. 5A is a sectional view of the one-way clutch of FIG. 4 showing a state of transmitting a rotation torque.
Figure 5B:
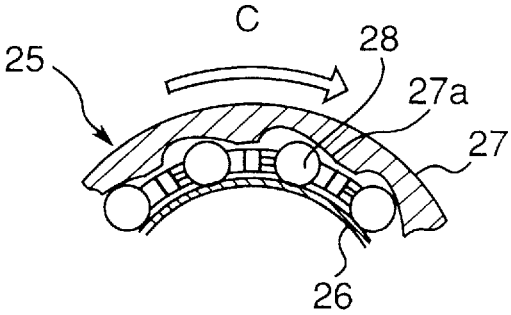
FIG. 5B is a sectional view of the one-way clutch of FIG. 4 showing a state of over-running.

In the aforementioned embodiment, although the shaft 7 of the rollers 7*a* is directly connected to the feed motor 2*b,* it is preferable to interpose a one-way clutch 25 between the shaft 7 of the rollers 7*a* and the feed motor 2*b* as shown in FIG. 4. The one-way clutch 25 is a well known device comprising, as shown in Fig. 5A and FIG. 5B, an inner race 26, an outer race 27 having cam surface 27*a* and a plurality of rollers 28 disposed between the inner race 26 and the outer race 27. The inner race 26 is connected to the feed motor 2*b*. On the outer race 27 is integrally formed a gear 27*b* which is engaged with a gear 7*b* fitted on the shaft 7 of the feed rollers 7*a*.

When the motor 2*b* rotates in the direction of an arrow A in FIG. 4, the rollers 28 come into pressure contact with the cam surfaces 27*a* so that a rotation torque of the feed motor 2*b* is transmitted to the shaft 7 of the feed rollers 7*b* through the one-way clutch 25 and gears 27*b* and 7*b*. This causes the shaft 7 of the rollers 7*b* to rotate in the direction of an arrow B in FIG. 4 and causes the medicine bag 1 to be fed out of the cassette 2 to the conveyance rollers 12*b*.

Then, when the front end of the medicine bag 1 is taken hold of by the conveyance rollers 12*b*, since the conveyance speed of the conveyance rollers 12*b* is faster than that of the feed rollers 7*a*, a tension load is applied to the medicine bag 1. As a result, the tension load provides the feed rollers 7*a* with an over-load higher than the rotation torque of the feed rollers 7*a*, which allows the cam surface 27*a* of the outer race 27 to retreat from the roller 28 in the direction of an arrow C in Fig, 5B. Thus, the feed rollers 7*a* over-run relative to the feed motor 2*b*, allowing the medicine bag 1 to be drawn out of the cassette 2 in a condition not under load and preventing the medicine bag 1 from tearing.

The one-way clutches 25 may be provided instead of the feed rollers 7*a* so that the one-way clutches 25 make contact with the medicine bag 1. In such case, it is preferable to provide rubber on the outer surface of the outer race 27 of the one-way clutch 25 to prevent slipping.

In the aforementioned embodiment, although two printers 4 are provided, three or more printers 4 or only one single printer 4 my be provided.

In the aforementioned embodiment, although three types of medicine bags 1 different in size are used, about eight types of medicine bags 1 which are typically used in a hospital may be used. In such case, the number of cassettes 2 may be increased in accordance with the types of medicine bags 1.

Although the present invention has been fully described by way of the examples with reference to the accompanying drawings, it is to be noted that various changes and modifications will be apparent to those skilled in the art. Therefore, unless such changes and modifications otherwise depart from the spirit and scope of the present invention, they should be construed as being included therein.

What is claimed is:

1. An apparatus for printing information on medicine bags, said apparatus comprising:

a plurality of medicine bag containers to contain different types of medicine bags;

a plurality of printers, each being operable to print information on a medicine bag;

a plurality of conveyors, each said conveyor being paired with a respective said printer, and each said conveyor being operable to convey a medicine bag from an inlet thereof to an outlet thereof and then to said respective printer;

a plurality of introducing portions defining medicine bag discharge paths aligned with respective said containers;

each said conveyor being pivotable at said outlet thereof such that said inlet thereof is selectively alignable with a selected one of plural of said introducing portions;

said introducing portions including at least one switching member that is pivotable at an inlet thereof to enable an outlet thereof to be aligned selectively with said inlet of any one of said conveyors, such that a medicine bag from the said container aligned with said at least one switching member can be conveyed selectively by any one of said conveyors to the respective said printer; and control means, operatively connected to said containers, said conveyors and said printers, for selecting a given said container, for causing one said conveyor to pivot to a position to receive a medicine bag from said given container, for causing said one conveyor to convey the medicine bag to one said printer paired with said one conveyor, and for causing said one printer to print information on the medicine bag.

2. An apparatus as claimed in claim 1, wherein said plurality of containers are spaced vertically.

3. An apparatus as claimed in claim 1, comprising two said printers, two said conveyors and one said switching member.

4. An apparatus as claimed in claim 3, comprising five said containers.

5. An apparatus as claimed in claim 1, wherein said container aligned with said switching member is sized to accommodate medicine bags intended for frequent use.

6. An apparatus as claimed in claim 5, wherein said control means is operatively connected to said switching member for, when one said printer is being operated to perform a printing operation, causing said switching member to pivot to a position to enable conveyance of a medicine bag from said container aligned with said switching member to another said printer that is not being operated to perform a printing operation.

7. An apparatus as claimed in claim 1, wherein said control means is operatively connected to said switching member for, when one said printer is being operated to perform a printing operation, causing said switching member to pivot to a position to enable conveyance of a medicine bag from said container aligned with said switching member to another said printer that is not being operated to perform a printing operation.

8. An apparatus as claimed in claim 1, wherein each said container includes feed rollers positioned to contact an upper medicine bag of a plurality of medicine bags to be contained in said each container, and a feed motor to operate said feed rollers to feed the medicine bags one by one from said each container.

9. An apparatus as claimed in claim 8, further comprising a one-way clutch interposed between said feed motor and said feed rollers and operable to transmit a rotation torque of said feed motor to said feed rollers and to over-run said feed motor when a load greater than said rotation torque is applied to said feed rollers.

10. An apparatus as claimed in claim 8, wherein said feed rollers comprise a one-way clutch operable to transmit a rotation torque of said motor to the medicine bag and to over-run said feed motor when a load greater than said rotation torque is applied to the medicine bag.

* * * * *